United States Patent [19]

Fischer

[11] 4,227,685

[45] Oct. 14, 1980

[54] SHEET FEEDING APPARATUS, PARTICULARLY FOR ROTARY PRINTING MACHINES

[75] Inventor: Hermann Fischer, Augsburg, Fed. Rep. of Germany

[73] Assignee: Maschinenfabrik Augsburg-Nürnberg Aktiengesellschaft (M.A.N.), Augsburg, Fed. Rep. of Germany

[21] Appl. No.: 902,422

[22] Filed: May 3, 1978

[30] Foreign Application Priority Data

May 7, 1977 [DE] Fed. Rep. of Germany ..... 2720599
May 7, 1977 [DE] Fed. Rep. of Germany ..... 2720675

[51] Int. Cl.[3] ..... B65H 3/08; B65H 5/02; B65H 9/10; B65H 9/16

[52] U.S. Cl. ..... 271/13; 271/236; 271/251; 271/252; 271/270

[58] Field of Search ..... 271/13, 12, 236, 237, 271/238, 270, 239, 250, 251, 252, 240, 98, 93, 91, 11, 10

[56] References Cited

U.S. PATENT DOCUMENTS

| | | | |
|---|---|---|---|
| 2,170,488 | 8/1939 | Spiess | 271/270 X |
| 2,205,921 | 6/1940 | Clarke | 271/13 |
| 2,249,504 | 7/1941 | Trydal | 271/13 |
| 2,841,391 | 7/1958 | Norton | 271/270 X |
| 3,938,800 | 2/1976 | Wirz | 271/93 |

FOREIGN PATENT DOCUMENTS

| | | | |
|---|---|---|---|
| 840847 | 6/1952 | Fed. Rep. of Germany . | |
| 1230041 | 12/1966 | Fed. Rep. of Germany . | |
| 2452050 | 5/1976 | Fed. Rep. of Germany | 271/236 |
| 2452051 | 5/1976 | Fed. Rep. of Germany | 271/236 |
| 2457070 | 6/1976 | Fed. Rep. of Germany | 271/236 |
| 2509276 | 9/1976 | Fed. Rep. of Germany | 271/236 |
| 1138896 | 1/1969 | United Kingdom | 271/10 |

*Primary Examiner*—Bruce H. Stoner, Jr.
*Attorney, Agent, or Firm*—Frishauf, Holtz, Goodman & Woodward

[57] ABSTRACT

To align sheets being fed to a printing machine without interruption of smooth flow of sheet feeding, the sheets are aligned while they are being fed from a stack to a set-up or alignment table 19 by imparting thereto a lateral force to direct the moving sheets towards a side or lateral stop. The vectorial lateral force component can be obtained by skewing transport belts 33 laterally, providing a transversely running belt 83 with freely movable engagement balls to press the sheets against the transversely moving belt, or tilting the transport table or conveyor system 17 and imparting vibration thereto so that the sheets will be jogged against a lateral stop 45, arriving properly longitudinally as well as laterally oriented at the set-up or alignment table for subsequent feeding into the printing machine. Preferably, the drive mechanism for the transport conveyor belts includes a variable speed transmission to selectively control overlap of subsequent sheets being fed.

7 Claims, 7 Drawing Figures

PHASE SHIFT GEARING

SHEET FEEDING APPARATUS, PARTICULARLY FOR ROTARY PRINTING MACHINES

The present invention relates to sheet feeding apparatus, and more particularly to sheet feeding apparatus for use with rotary printing machines, especially rotary offset printing machines, in which sheets are separated from a stack and fed to a printing station, individually, in oriented alignment.

BACKGROUND AND PRIOR ART

Sheet-fed rotary offset printing machines customarily are so arranged that sheets are separated from a stack and transported over an alignment or orientation table to a point adjacent the printing machine itself at which the respective sheets are placed, oriented and aligned with respect to lateral and end marks or stops, so that the sheets will be fed accurately both with respect to their longitudinal alignment as well as their end position into the printing system. The sheets, fed separately over the set-up or alignment table, are then transported into the printing machine itself by means of a sheet transport arrangement which is part of the printing system. The sheets are fed to the transport arrangement of the printing machine from the stack by means of a sheet transport conveyor until the sheets engage the front stops or alignment markers of the alignment tables. The sheets which are aligned and engage the forward stops or markers of the alignment table can be moved laterally, perpendicularly to the direction of main movement towards the printing machine, in order to engage lateral edge stops of the alignment table. The drive for the sheet transport arrangement for the alignment transmission ratio.

Sheets transport arrangements of the type described are known from the literature—see, for example, German Patent No. 1,230,041. This patent discloses transport of single sheets which have already passed through a printing machine to a laminating or pasting machine, that is, to transport already printed sheets for subsequent processing. If the speed of the supply arrangement, that is, of the transport conveyor associated with the alignment table is changed, it is necessary to change the operating speed of the alignment table release or stop arrangement as well and, additionally, to change the speed of the sheet feeding system which places the sheets, usually in staggered, overlayed, overlapping arrangement on the alignment table for subsequent transport. This is a disadvantage since the arrangement can no longer be operated in synchronism with a printing machine since proper transfer of a sheet to a printing machine can no longer be assured.

The systems as disclosed use a lateral pull arrangement, operating in synchronized steps, to pull the sheets to a lateral or side marker or stop. These movements usually are only over a short distance; they do require a certain minimum time, however, which may be independent of the operating speed of the machine which processes the sheets themselves. The lateral shifting time can occur only at a well defined time duration and must be terminated when the next sheet reaches the alignment table. This requires a certain minimum overlap distance if the sheets are overlapped when being supplied; the stiffness of the material itself determines the maximal permissible engagement speed of the sheets on the alignment markers or stops of the alignment table. The static loading on the stops and on the sheets also limits the maximum transport speed on the supply table which, then, determines the maximum repetition frequency or cycling frequency of the machine which processes the sheets themselves.

German Patent No. 840,847 discloses a sheet supply arrangement of the type generally referred to. This arrangement differs from that of the foregoing literature reference in that the sheets are transported singly, that is, without overlap, and the system is so designed that any sheet overlap is avoided. Such arrangements result in low operating speed since the cycling time of any sheet processing system—for example a printing system—taking over the separated sheets must be limited to a value which, at the time of the patent, was high, but does not meet current requirements. In other respects as well, the arrangement has the disadvantages of the aforementioned structure.

THE INVENTION

It is an object to provide a sheet supply system, particularly for cooperation with a rotary offset printing machine in which the sheets are supplied at a high rate with proper lateral as well as frontal alignment exceeding maximum permissible impingement speeds of the sheets on alignment markers or stops, while still presenting sheets of flexible material to lateral stops without damage.

Briefly, lateral sheet pulling arrangements, which are usually present on such machines, can be selectively disconnected; to align the sheets on lateral markers, a sheet feeding movement having a vectorial component transverse to the normal or main sheet feeding direction is superimposed on the normal sheet feeding movement, so that the resulting feed of the sheet will direct the sheet on the lateral markers of the alignment table as well as on the frontal stops or markers thereof. The drive speed of the sheet supply system, e.g., a conveyor cooperating with the alignment table is preferably through a variable speed transmission; the operating movement itself is synchronized with that of the sheet processing machine, typically a rotary offset printing machine.

In accordance with a feature of the invention, the sheet feeding speed can be changed to such an extent that it can be slowed by a factor in the order of two or more with respect to the drive speed of the printing machine. This permits changing of the overlap distance of succeeding sheets being fed to the printing machine. For example, the overlap distance can be decreased already on the supply table with respect to customary commercial supply conveyor systems to about half the distance, thus permitting approximately doubling the operating speed of the printing machine connected thereto. Conversely, and when using a printing machine the speed of which is not to be doubled, sheets of lesser weight can be handled, although the operating speed of the printing machine is then not increased, so that the advantage of higher printing speed is not obtained. Yet, the system is capable of handling lighter weight paper, or paper of poorer quality, and especially paper with which, heretofore alignment could be obtained only after the paper has stopped longitudinal movement so that, previously, it was placed or aligned laterally only after having terminated its forward feed motion towards the printing machine.

Specific types of paper conveyor arrangements are the subject of the prior published German Disclosure documents DE-OS Nos. 25 09 276; 24 57 070; and 24 52

050, all by the inventor hereof and assigned to the assignee of this application. Systems as proposed can be used to impart the transverse vectorial component of force to the sheet being fed in order to provide for simultaneous lateral and front alignment of the sheet. In one embodiment, a number of parallel endless conveyor ribbons are placed transversely with respect to the main feeding direction of the sheet, the sheet being pressed against one run of the belts by engagement elements, preferably balls, which are freely rotatable in a cage and selectively movable to press the sheets against the transverse belts. In another form, a group of parallel endless conveyor belts are provided, running over spaced shafts, the longitudinal position of which is axially relatively shiftable so that the conveyor belts will run at an inclination with respect to the major transport direction of the sheet, thus providing a forward or longitudinal and lateral, or side vectorial component of drive force for a sheet in engagement therewith. In yet another form, the supply table can be arranged to rock about a longitudinal axis thereof while being subjected to vibrations, thus jogging the sheet towards the lower, lateral edge of the table by gravity, the vibration preventing adhesion of the sheets and permitting lateral shift under force of gravity.

Drawings, illustrating preferred examples:

The invention is particularly applicable in connection with rotary offset printing machines, and will be described in connection therewith; it is, however, also applicable to other types of cyclically operating machines which process sheets such as paper sheets, cardboard sheets, and the like.

Figure 1:
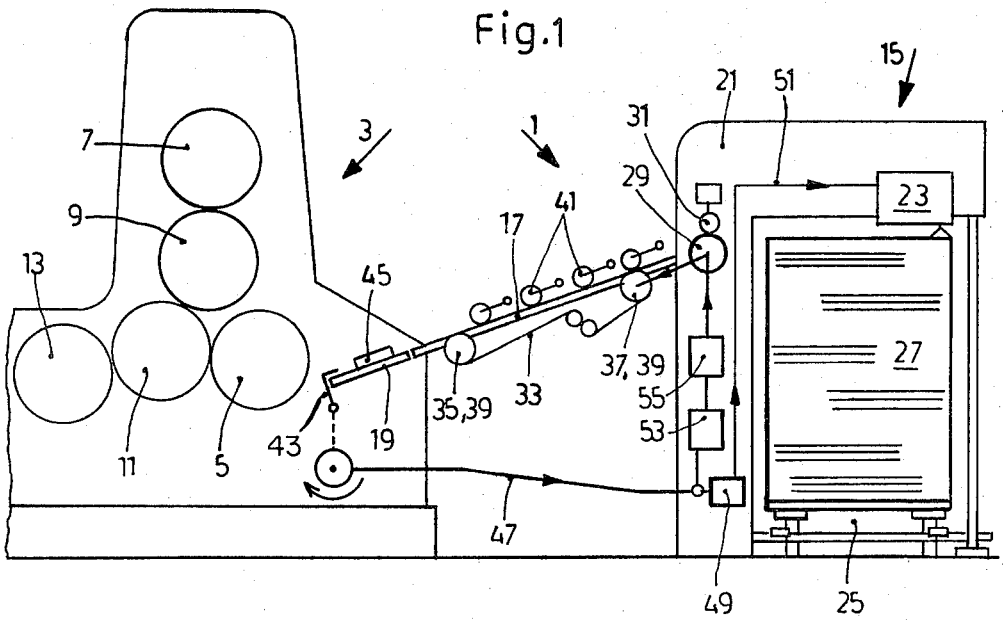
FIG. 1 is a highly schematic side view of a sheet supply system for association with a rotary offset printing machine.

The sheet supply arrangement 1 cooperates with a rotary offset printing machine 3 (FIG. 1). Only one supply cylinder 5, a plate cylinder 7, blanket cylinder 9, counter cylinder 11 and transfer cylinder 13 of the offset printing machine are shown. The sheet transfer arrangement 1 uses a sheet supply unit or stage 15, a conveyor table 17 and an alignment table 19. The alignment table 19 cooperates with a gripping system, not further shown, and as well known, to supply aligned sheets to the cylinder 5 of printing machine 3.

The sheet supply stage 15 has a frame 21 on which a separating mechanism 23 (see also FIG. 3) is located, to feed and separate the upper sheet of a stack of sheets 27, located on a pallet 25 which is placed in the frame 21. The sheets separated by the mechanism 23 are supplied to a first transport roller 29 which transports the sheets to the conveyor table 17 when the sheets are pressed against the transport roller 29 by one or a group of selectively operable counter rollers 31 which for short instants of time are moved downwardly, for example by an electrical or pneumatic operator, to press the first fed sheet against the rotating roller 29.

The conveyor table 17 has a plurality of mutally respectively parallel endless conveyor belts 33 which are looped over two shafts 35, 37, each of which are supplied with suitable rollers or drums 39. Counter rollers 41, acting on the top of sheets fed to the conveyor belts 33, press the sheets delivered by the transport roller 29 on the conveyor belts 33, so that they can be supplied to the alignment table 19 in overlapping, superimposed positions.

The alignment table 19 has suitable alignment stops. Frontal stops 43 are movable, that is, they can swing or rock downwardly (FIG. 1) under a cyclically operating control, for example under control of a cam. The frontal stops 43 thus are cyclically controlled to release sheets which impinged previously on the stops 43. Additionally, the alignment table 19 has at least one stationary lateral stop 45 in order to align sheets which are supplied by the conveyor belts 33 with respect to lateral alignment, for subsequent transport by the introduction system or sheet gripping arrangement of the printing machine itself. The sheets on the alignment table, thus, are prepared in properly aligned relationship with respect to the transport cylinders and subsequent printing cylinders of the printing machine.

The drive of the system is obtained from the printing machine 3. A drive shaft, shown schematically at 47, which may include one or more universal joints, is connected to the frame 21. At frame 21, rotary movement of the drive shaft is branched to a gearing 49 which is connected through further shafts or rotating coupling elements 51 to the separating mechanism 23. Another branch of the drive system extends to a variable speed transmission 53 and then through an oscillating gearing 55 to the transport roller 29 of the sheet feeding apparatus. The sheet transport roller 29 is also connected to the shaft 37 of the pulleys or rollers 39 with which the belts 33 are engaged to provide drive to the belts. The belts themselves are tensioned by a suitable tensioning arrangement, as shown schematically in FIG. 1. The alignment table 19 or, rather, the front stops 43 of the alignment or set-up table, are directly driven from the printing machine by means not specifically shown, for example by cams controlling the position of the stops 43.

Figure 2:
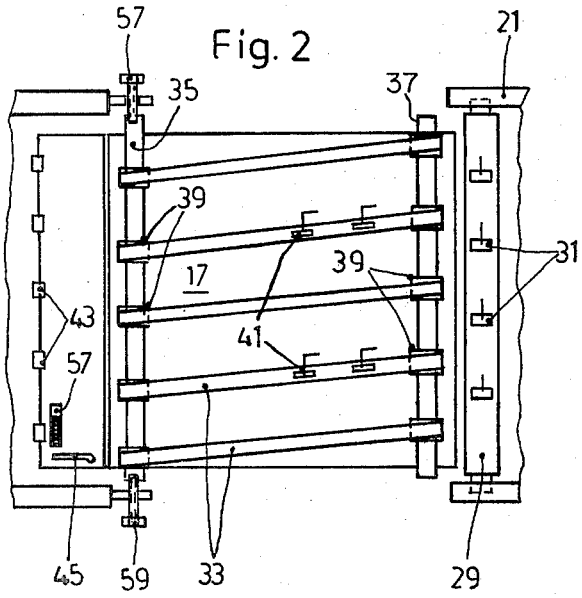
FIG. 2 is a top view of a first embodiment.
Figure 7:
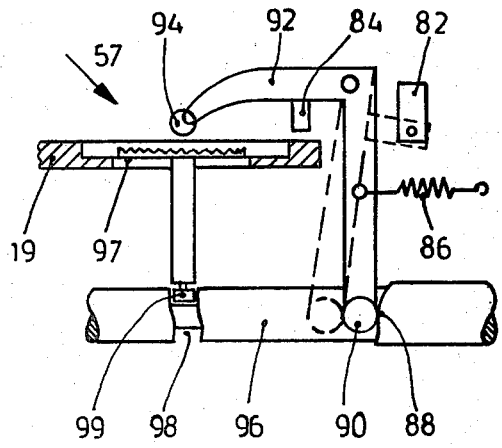
FIG. 7 is a lateral pull arrangement with a disconnection latch, in side view.

FIG. 2 illustrates, at the left side, a customary lateral pull arrangement 57, shown also in greater detail in FIG. 7. Such an arrangement is used frequently, particularly when handling sheet material which is relatively flexible and when the sheets cannot be readily pushed laterally without buckling or bulging at their forward edge; or when the sheets, when stopped, and without essential loading or engagement by a subsequent overlapping sheet must be pulled to the lateral marker or stop 45 of the alignment table 19. The transport belts 33 of the conveyor table 17 then are oriented to operate at right angles to, essentially, the edge defined by the stops 43—contrary to the position shown in FIG. 2. The sheets, then, are fed essentially straight to the front stops 43.

In accordance with an important feature of the invention, the lateral pull system 57 can be disconnected. Lateral alignment of the sheets is obtained by applying a lateral vectorial force on the sheets when they are still on the supply table 17. Thus, the sheets are acted on, while on the supply table, in two respectively perpendicular directions. The lateral pull exerted on the sheets by the arrangement 57 of FIG. 7 is then replaced by a lateral force acting on the sheets while they are transported by the conveyor system 33, 41. This is particularly appropriate if the sheets are of a material which is relatively stiff, for example of calendared paper, cardboard or the like. With quite stiff material, such as cardboard, the alignment of the sheets can be entirely effected by imparting a lateral vectorial force component thereto, thus permitting increase of the working or operating speed of the printing machine 3 to a substantial degree by utilizing the stiffness of the sheet in combination with its maximum permissible impingement speed on the frontal stops 43.

In accordance with a feature of the invention, as illustrated in FIG. 2, a combined sheet feeding force as well as a lateral alignment force towards the lateral marker 45 is obtained by shifting the belts 33 laterally to assume the inclined—with respect to the major sheet feeding direction—position shown in FIG. 2. The net, resulting feed direction will then have a vectorial component laterally directed towards the side alignment marker or stop 45, as well as the major feeding component directed towards the frontal stops 43. Inclining the position of the belts 33 can be obtained by axially shifting the rollers or pulleys 39 on shaft 37 with respect to the rollers or pulleys on shaft 35. Either one of the shafts may be shifted; FIG. 2 illustrates axial positioning of the shaft 35, which is the idling, or non-driven, shaft by two screws 57, 59 which engage the facing ends of the shaft 35, for example through bearings, or which merely locate the shaft 35 in the desired axial position, the rollers 39 running on individual bearings on the shaft 35. To prevent the belts 33 from slipping off the rollers 39 on the shafts, the rollers are preferably formed with a part-spherical outer circumference.

In operation of the embodiment of FIG. 2, the sheets fed by the separating mechanism 23 through roller 29 are then fed by the conveyor belts 33 in a somewhat inclined direction, in FIG. 2 in a downwardly inclined direction towards the alignment table 19. The front edges of the sheets, of course, will remain parallel to the major feed direction, that is, parallel to the stops 43, or at least essentially so. The front edge will impinge essentially uniformly, straight, on the front markers 43 and, by suitable inclination of belts 33, will also ensure simultaneous engagement with the lateral marker 45. The continued operation of the belts 33 will have a pushing, aligning effect on the sheets so that, due to the continued movement of the belts 33, as well as the continued movement of overlapping subsequent sheets, the lateral force provides for effective complete alignment of the sheets against the frontal stops 43 and the lateral stop 45 before the respectively foremost sheet is further transported into the printing machine.

Figure 3:
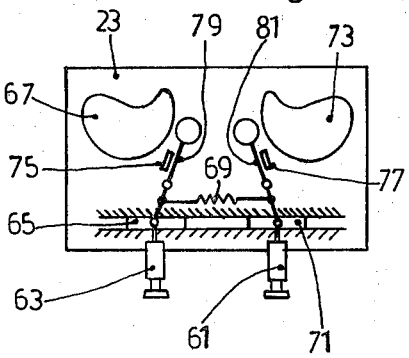
FIG. 3 is a highly schematic side view of a separating arrangement for the topmost sheet of a stack of sheets.

The separating arrangement is illustrated schematically in FIG. 3. Basically, it includes a plurality of lifting suction cups 61 which pick up the uppermost sheet of a stack 27 adjacent its trailing or rear edge. The sheet can then be accepted by a plurality of transport suction cups 63 which move the sheet to the transport roller 29. The transport suction cups 63, for example, are secured to a slider 65 which is moved by a cam 67 counter the force of a spring 69 in reciprocating movement, forwardly and backwardly with respect to the sheet transfer movement direction. It is not necessary that both the pick-up cup 63, and cup 61, which preferably is also secured to a slider 71 and controlled by a cam 73, be used. If the overlap distance is below a certain predetermined amount, the transport suction cup 63 need not be used since the rear edge of a preceding sheet may be in its place.

If the overlap distance is short, the suction cups 63 are disconnected and the sheet feed in the sheet feeder 15 must be taken over by the pick-up cups 61. The pick-up cups 61 then not only pick up a sheet at the rear edge, but also move it forwardly towards the transport roller 29. The cam disk 73 is rotated, the suction cups 61 reciprocating back and forth, counter the tension of spring 69, by movement of the slider 71 in a suitable track. Latches 75, 77 are provided to permit disengaging the cam followers 79, 81 from the respective cams and locking the cam followers out of engagement with the respective cams if the one, or the other, of the suction cups 61, 63 is not intended for movement. If the overlap is short at all times, then only a single arrangement, for example the arrangement of suction cup 61—cam follower 81—cam 73 need be provided, and the other suction cup 63 and its associated mechanism omitted entirely. Timed control of the suction effect of cups 61, 63, themselves, can be obtained by cam control, electrical control, or otherwise, as well known.

Figure 4:
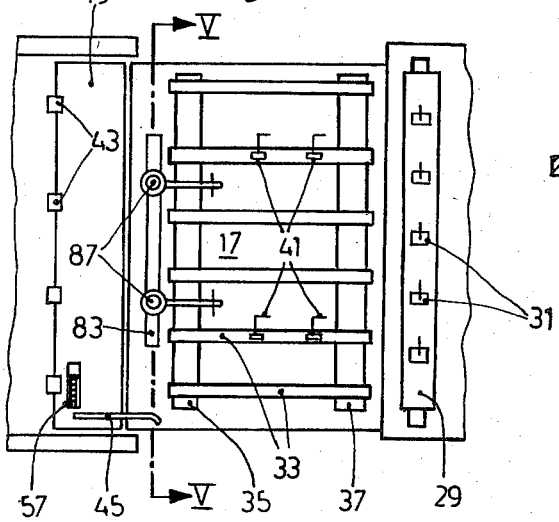
FIG. 4 is a schematic top view of another embodiment of a sheet transport arrangement.
Figure 5:
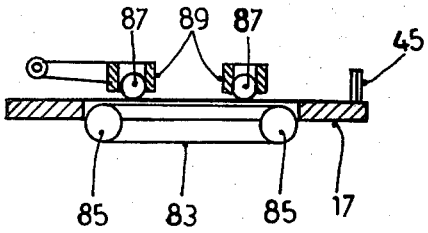
FIG. 5 is a sectional view along line V—V of FIG. 4.

Second embodiment, FIG. 4: The transport belts 33' are arranged to operate parallel to each other and parallel to the main feed direction, that is, have their usual customary orientation parallel to the lateral edges of the conveyor table 17. A lateral transfer belt 83 is provided, formed as an endless belt (see FIG. 5) and looped over two end rollers or sheaves 85. The upper run of the belt 83 is slightly below the plane of the supply table 17. A sheet which is supplied by the belts 33' is engaged with the transverse belt 83 by two presser balls 87 which are retained in holders or cups or races 89. The balls are freely rotatable in any direction and can move vertically in their holders or cups 89, thereby giving the sheet on the supply table free movement in both directions. The weight of the balls, which may be of steel, brass or the like, engages the sheet with the transverse belt 83 in order to move the sheet in the direction of the lateral stop 45.

Figure 6:
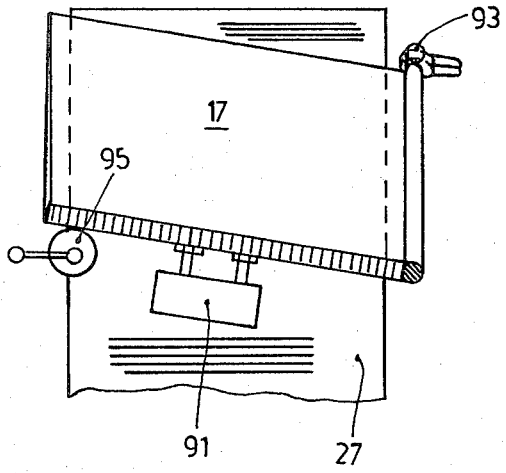
FIG. 6 is a top perspective view of another embodiment, partly in section.

Third embodiment, FIG. 6: The sheet can be transported over the transport or supply table 17 in inclined direction by tilting the supply table 17, together with the conveyor belts 33' about its longitudinal axis and towards the lateral stop 45, as seen in FIG. 6. In order to jog the sheet towards the lateral edge, the table 17 is vibrated by being acted on by a vibrator 91. Thus, the sheets will gradually shift towards the lateral stop 45 by their own weight, in spite of the engagement therewith of the upper presser or engagement rollers 41 which engage the sheets with the belts 33'. The table 17 is pivoted about a hinge 93, the pivoting adjustment being controllably arranged by moving an eccenter 95.

The supply or conveyor table 17 can be formed along its entire lateral edge with a side stop 45'. Thus, the stop 45 need not terminate, as shown, on the table 19, but can extend to or be integral with the table 17. Stops 45, 45' can be a single rail or can be formed as a plurality of pins, upstanding edge portions or the like. Extending stop 45, 45' towards the table 17 ensures reliable guidance of sheets at their edges and to properly propel them towards the front stops 43 while in engagement with the portion of the stop 45 closest to the front stops 43.

FIG. 7 illustrates a customary lateral pull mechanism 57. The alignment table 19 is formed with a recess extending transversely with respect to the major feed direction of the sheet. A reciprocable pulling bar 97 is located in the recess, the pulling bar being driven from a cam follower 99 engaged in a cam race 98 formed in a rotating shaft 96. Engagement roller 94, which reciprocates upwardly and downwardly, is secured to an angled lever 92. Angled lever 92 moves up and down under control of a cam follower roller 90 engaged with a cam 88 formed on shaft 96, being urged downwardly towards the transport shoe 97 counter the force of a spring 86. A sheet placed between the roller 94 and shoe 97 will be pressed into engagement with the shoe 97 by the roller 94 when the shoe 97 carries out a movement towards the lateral stop 45. In accordance with a feature of the invention, a latch 82 is provided which can be tipped downwardly from the solid-line to the broken-line position, thus disengaging cam follower 90 from cam 88 and disabling operation of the engagement roller 94. When latch 92 is placed into the broken-line position, lateral shifting movement of a sheet which already has been supplied from the supply table 17 is inhibited. The present invention, therefore, permits alignment already before the sheet is placed in the feed position with the front edge aligned against the frontal stops 43.

The variable transmission 53 can include a stepped gearing or can be a continuously variable transmission. If a stepped gearing, then the gear ratio is preferably so arranged that the number of sheets which overlap, when a sheet is on the supply table 17, is a whole number, thus ensuring a whole overlap ratio. If the transmission is a continuously variable transmission, suitable markers indicating the respective positions of the variable transmission are preferably provided. Thus, a predetermined overlap distance can be readily set, the overlap distance depending on the length of the supply table 17. It is not a necessary requirement, however, that the number of overlapping sheets on the table 17, at any instant of time, be a whole number.

The gearing 49 drives the pick-up device 23 (FIGS. 1, 3). This gearing may be fixed, without changing speed; it is preferably so arranged that the output rotation is phase-shifted, that is, is shifted in time with respect to the input rotation, to change the phase position of the separating device 23 with respect to the drive of the printing machine and, also, the drive of the supply table 17. Use of a continuously variable transmission for the transmission 53 permits operation with overlap numbers which are not whole numbers, that is, with any desired spacing of sequentially overlapping sheets. Use of a transmission 53 which is changed in steps will counteract any slippage of sheets on the supply table 17 and maintain any previously selected overlap distances.

The reduction gearing 55 can be used to feed sheets from the supply table 17 to the alignment table 19 at a decelerating rate, while maintaining an average transport speed. Thus, sheets can be fed to the alignment table 19 and then engage the forward stops 43 at a transport speed which is less than the average transport speed. Also, it is possible to change the pick-up speed of sheets as they are gripped by the rollers 29, 31 (FIG. 1), then accelerating the sheets and feeding them fast through the sheet feeding table 17 and then decelerating the sheets so that they will impinge against stops 43 at a lower rate, that is, with more gentle movement. The gearing 53, therefore, can be arranged to provide not only speed matching, but additionally a non-uniform, oscillating speed of sheets depending on the respective position of any individual sheet. The output from reduction gearing 55, thus, can be selectively connected separately to roller 29, and to the transport or conveyor rollers 37 driving belts 33, 33' separately. Gearing 55 will, then, provide an average desired or design speed to the sheets while, at any instant of feed, the sheet speed may differ, depending on the instantaneous position of the sheet on the feeding system.

Various changes and modifications may be made, and features described in connection with any one of the embodiments may be used with any of the others, within the scope of the inventive concept.

I claim:

1. Sheet feeding apparatus to feed separated sheets from a stack to a machine receiving said separated sheets, particularly to a sheet-fed rotary offset printing machine comprising the combination of cooperating means:

sheet separating means (23) separating a single sheet from a stack (27);

a set-up or alignment table (19);

front alignment means (43) movably positioned at a forward location of said set-up or alignment table to provide for frontal alignment of a sheet positioned on said table;

lateral alignment means (45) positioned at a side or lateral location of said set-up or alignment table (19) to provide for lateral alignment and guidance of a sheet positioned on said table;

a sheet transport conveyor means (17, 33) located between said separating means (23) and said set-up or alignment table (19) and transporting separated sheets in a transport or feed path or direction to said table;

drive means (47, 53, 55, 29, 39) including a variable speed transmission (53) in driving connection with said transport means;

a lateral sheet moving mechanism (57) positioned on said set-up or alignment table (19) and operable to impart lateral movement to a sheet positioned on said table to engage the sheet with said lateral alignment means (45);

means (82) connected to said lateral sheet moving mechanism (57) and selectively disabling said mechanism;

means ensuring engagement of a sheet being transported with the lateral alignment means (45) as it is being transported by said sheet transport conveyor means including means imparting a drive movement to a sheet on the conveyor means having a vectorial direction transverse to the direction of movement of the sheet from the separating means to the front alignment means (43) of the set-up or alignment table (19) by superimposing a drive force transverse to said direction of movement on the force exerted on the sheet by the sheet transport conveyor means to obtain a resulting force acting on the sheet which has a lateral component directed towards said lateral alignment means (45);

and the drive means (47, 53, 55, 29, 39) being coupled to the separating means and the front alignment means and being synchronized with the machine receiving said separated sheets;

and wherein said variable speed transmission in driving connection with said sheet transport conveyor means (17, 33) has a ratio of speed change to provide for decrease of speed of operation of said sheet transport conveyor means with respect to the machine receiving said separated sheets by a factor in the order of magnitude of about two.

2. Apparatus according to claim 1, wherein (FIG. 2) the sheet transport conveyor means (17, 33) comprises a plurality of essentially parallel, elongated conveyor belts (33) having a belt run adapted for engagement with a sheet being fed in the sheet feeding direction;

and wherein said means imparting a transverse vectorial drive direction comprises means shifting the direction of said run to be inclined with respect to the major longitudinal feed direction.

3. Apparatus according to claim 1, wherein (FIG. 4) said means imparting a transverse vectorial drive direction comprises an endless belt (83) arranged in a run which is transverse to the main feed direction of said sheet transport means (17, 33), one run being slightly spaced from a sheet being transported on said sheet transport means;

and at least one ball element (87) located opposite a sheet and in alignment with said run and positioned to press a sheet against said transversely operating belt (83).

4. Apparatus according to claim 1, wherein (FIG. 6) said means imparting a transverse vectorial drive movement comprises means tilting said sheet transport conveyor means about an axis parallel to the direction of sheet feeding movement of said sheet transport conveyor means, and vibrator means (91) vibrating said sheet transport conveyor means to jog a sheet on said sheet transport conveyor means to move, by gravity, in said transverse direction.

5. Apparatus according to claim 1, wherein said sheet separating means (23) comprises two suction cups (61, 63);

and means selectively moving, or disabling from movement, either one, or neither, of said suction cups, said suction cups being movable, selectively, in sheet feeding direction to said sheet transport conveyor means (17, 33).

6. Apparatus according to claim 1, wherein said variable speed transmission (53) of the drive means to drive said sheet transport conveyor means (17, 33) is a gear change transmission having at least two gear ratios.

7. Sheet feeding apparatus to feed separate sheets from a stack (27) to a machine (3) particularly for combination with a sheet-fed rotary offset printing machine comprising the combination of cooperating means;

sheet separating means (23) separating a single sheet from the stack (27);

a set-up or alignment table (19) adjacent the machine (3);

front edge alignment means (43) movably positioned on a forward location of the set-up or alignment table to provide for frontal alignment of the sheet positioned on said set-up table when the alignment means are in a sheet alignment position, and release of the sheet when the alignment means are moved to a release position;

lateral edge alignment means (45) positioned at the side or lateral location of the set-up or alignment table (19) to provide for lateral alignment and guidance of a sheet positioned on said table;

a sheet transport conveyor means (17, 33) located between said separating means (23) and the set-up or alignment table (19) and transporting separated sheets to the set-up table;

means ensuring engagement of a sheet being transported on said transport means with the lateral alignment means (45) as the sheet is being transported on said sheet transport means, and prealignment of the sheet in advance of said set-up or alignment table (19) including means positioned in advance—in the direction of sheet transport—of the alignment table (19) imparting a drive movement on the sheet while the sheet is on said sheet transport conveyor means and having a vectorial direction transverse to the direction of movement of the sheet from the separating means to the front alignment means of the set-up or alignment table (19) by superimposing a drive force transverse to said direction of movement on the force exerted on the sheet by the sheet transport conveyor means to obtain a resulting force acting on the sheet which has a lateral component directed towards said lateral alignment means (45);

drive means (47, 53, 55; 29, 39) including a variable speed transmission in driving connection with said sheet transport conveyor means, and coupled to the sheet separating means (23), to the movable front alignment means (43) and to the machine (3) to synchronize operation of the separating means, the sheet transport conveyor means and the movement of the front alignment means with the machine receiving the separated sheet;

a lateral sheet moving mechanism (57) located on said set-up or alignment table (19) and operable to move a sheet positioned in engagement with said front alignment means (43) and laterally into engagement with said lateral alignment means (45);

and selectively operable lock-out means (82) engageable with said lateral sheet moving mechanism (57) to selectively disable said lateral sheet moving mechanism and permit placement of a sheet being fed by said sheet transport conveyor means into engagement with said lateral alignment means (45) by said transverse drive movement imparting means.

* * * * *